US006824475B2

(12) United States Patent
Burnett et al.

(10) Patent No.: US 6,824,475 B2
(45) Date of Patent: Nov. 30, 2004

(54) GOLF CLUB HEAD

(75) Inventors: Michael Scott Burnett, Carlsbad, CA (US); Benoit Vincent, Leucadia, CA (US); Todd Beach, San Diego, CA (US); Stephen Kraus, San Diego, CA (US); Yong Ling, Vista, CA (US); David Anderson, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 31 days.

(21) Appl. No.: 09/898,843

(22) Filed: Jul. 3, 2001

(65) Prior Publication Data

US 2003/0013542 A1 Jan. 16, 2003

(51) Int. Cl.[7] ..... A63B 53/04

(52) U.S. Cl. ..... 473/329; 473/342; 473/345; 473/349; 473/409

(58) Field of Search ..... 473/324, 325, 473/326, 327, 328, 329, 330, 331, 332, 334, 333, 335, 336, 337, 338, 339, 340, 341, 342, 343, 344, 345, 346, 347, 348, 349, 350, 291, 409; D21/733–753

(56) References Cited

U.S. PATENT DOCUMENTS

| | | | | |
|---|---|---|---|---|
| 4,189,144 | A | | 2/1980 | Guzzle et al. |
| 4,213,613 | A | | 7/1980 | Nygren |
| 4,398,965 | A | | 8/1983 | Campau |
| 4,432,549 | A | * | 2/1984 | Zebelean |
| 4,511,145 | A | | 4/1985 | Schmidt |
| 4,809,978 | A | | 3/1989 | Yamaguchi |
| 4,826,172 | A | | 5/1989 | Antonious |
| 4,915,386 | A | | 4/1990 | Antonious |
| 4,919,430 | A | | 4/1990 | Antonious |
| 4,928,965 | A | | 5/1990 | Yamaguchi |
| 4,929,430 | A | | 5/1990 | Otomura et al. |
| 4,930,781 | A | | 6/1990 | Allen |
| 4,932,658 | A | | 6/1990 | Antonious |
| 5,024,437 | A | * | 6/1991 | Anderson |
| 5,060,951 | A | | 10/1991 | Allen |
| 5,090,702 | A | | 2/1992 | Viste |
| 5,176,383 | A | | 1/1993 | Duclos |
| 5,242,167 | A | | 9/1993 | Antonious |
| 5,259,614 | A | | 11/1993 | Greer |
| 5,318,300 | A | | 6/1994 | Schmidt |
| 5,346,216 | A | | 9/1994 | Aizawa |
| 5,362,047 | A | | 11/1994 | Shaw et al. |
| 5,397,126 | A | | 3/1995 | Allen |
| RE34,925 | E | | 5/1995 | McKeighen |
| 5,423,535 | A | | 6/1995 | Shaw et al. |
| 5,425,535 | A | | 6/1995 | Gee |
| 5,425,538 | A | * | 6/1995 | Vincent |
| 5,439,223 | A | | 8/1995 | Kobayashi |

(List continued on next page.)

FOREIGN PATENT DOCUMENTS

| | | |
|---|---|---|
| FR | 2635688 | 3/1990 |
| GB | 2 332 14 9 | 6/1999 |
| JP | 4950063 | 2/1974 |

(List continued on next page.)

*Primary Examiner*—Sebastiano Passaniti
(74) *Attorney, Agent, or Firm*—Sheppard, Mullin, Richter & Hampton LLP

(57) ABSTRACT

A golf club head is provided having a substantially increased sweet spot across its club face. A preferred construction includes an annular area on a rear surface having increased thickness surrounding a central region with a balance point of the club face. The central region of the face has a generally reduced thickness that is less than the maximum of the annular area but greater than a minimum thickness at the peripheral area. The face material may be metallic, but in alternative embodiments the effective bending stiffness profiles represented by this annular area may be achieved by appropriate use of composites, for example. Methods for manufacturing a golf club head having a face with the bending stiffness profiles of the present invention include forging and machining techniques as well as laser deposition and inertia welding.

69 Claims, 8 Drawing Sheets

U.S. PATENT DOCUMENTS

| | | | | |
|---|---|---|---|---|
| 5,451,056 | A | | 9/1995 | Manning |
| 5,451,058 | A | | 9/1995 | Price et al. |
| 5,505,453 | A | | 4/1996 | Mack |
| 5,527,034 | A | | 6/1996 | Ashcraft et al. |
| 5,564,994 | A | | 10/1996 | Chang |
| 5,586,947 | A | | 12/1996 | Hutin |
| 5,601,501 | A | | 2/1997 | Kobayashi |
| 5,611,742 | A | | 3/1997 | Kobayashi |
| 5,643,108 | A | * | 7/1997 | Cheng |
| 5,649,872 | A | | 7/1997 | Antonious |
| 5,669,829 | A | | 9/1997 | Lin |
| 5,676,605 | A | | 10/1997 | Kobayashi |
| 5,697,855 | A | | 12/1997 | Aizawa |
| 5,711,722 | A | | 1/1998 | Miyajima et al. |
| 5,735,755 | A | | 4/1998 | Kobayashi |
| 5,776,011 | A | | 7/1998 | Su et al. |
| 5,788,584 | A | | 8/1998 | Parente et al. |
| 5,830,084 | A | | 11/1998 | Kosmatka |
| 5,836,830 | A | | 11/1998 | Onuki et al. |
| 5,873,795 | A | | 2/1999 | Wozny et al. |
| 5,911,637 | A | | 6/1999 | Yamagata |
| 5,921,869 | A | | 7/1999 | Blough et al. |
| 5,921,872 | A | | 7/1999 | Kobayashi |
| 5,954,596 | A | | 9/1999 | Noble et al. |
| 5,971,868 | A | | 10/1999 | Kosmatka |
| 5,993,331 | A | | 11/1999 | Shieh |
| 6,007,432 | A | | 12/1999 | Kosmatka |
| 6,030,294 | A | | 2/2000 | Shira |
| 6,083,123 | A | | 7/2000 | Wood |
| 6,120,388 | A | | 9/2000 | Blough et al. |
| 6,319,150 | B1 | * | 11/2001 | Werner |
| 2001/0000337 | A1 | | 4/2001 | Naruo et al. |
| 2001/0012804 | A1 | | 8/2001 | Matsunaga et al. |
| 2001/0051548 | A1 | | 12/2001 | Iwata et al. |

FOREIGN PATENT DOCUMENTS

| | | |
|---|---|---|
| JP | 4347179 | 12/1992 |
| JP | 05237207 | 9/1993 |
| JP | 08155060 | 6/1996 |
| JP | 09168613 | 6/1997 |
| JP | 09192270 | 7/1997 |
| JP | 09225075 | 9/1997 |
| JP | 11076473 | 3/1999 |
| WO | WO 01/32272 A1 | 5/2001 |

* cited by examiner

FIG. 12
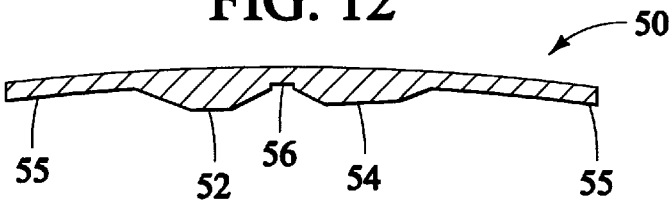
FIG. 11
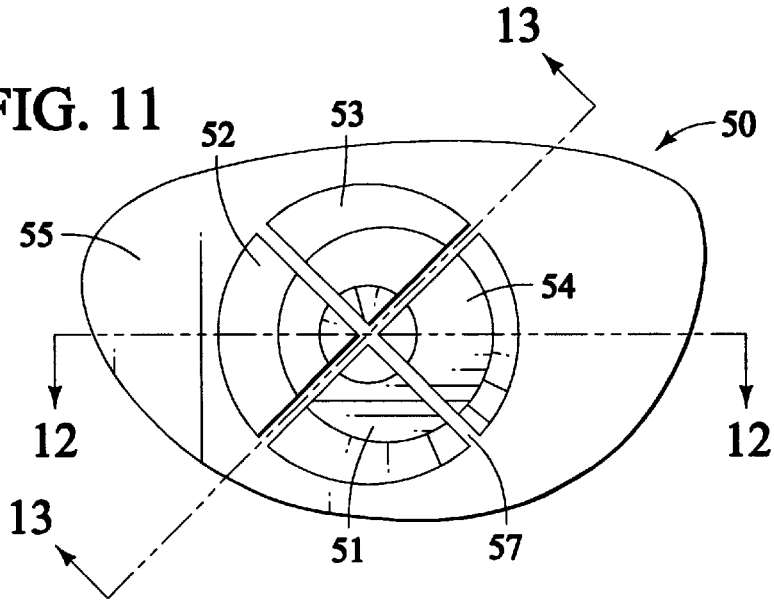
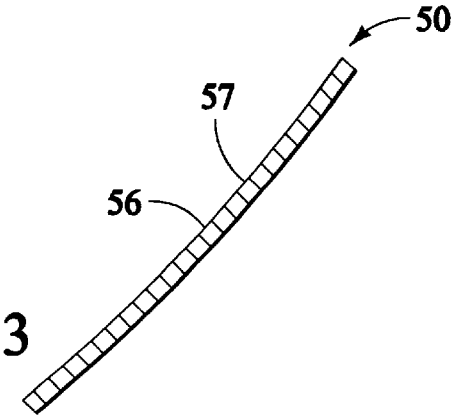
FIG. 13

GOLF CLUB HEAD

BACKGROUND OF THE INVENTION

The present invention relates generally to golf club heads and, more particularly, to golf club heads having an improved face construction.

Modern golf clubs have typically been classified as woods, irons or putters. Additionally, a newer class of golf clubs termed "utility" clubs or "iron woods" seek to replace low lofted long irons or higher numbered fairway woods. The term "wood" is an historical term that is still commonly used, even for golf clubs that are constructed of steel, titanium, fiberglass and other more exotic materials, to name a few. The woods are now often referred to as "metal woods." The term "iron" is also an historical term that is still commonly used, even though those clubs are not typically constructed of iron, but are rather constructed of many of the same materials used to construct "woods".

One particular improvement that relates especially to metal woods is the use of lighter and stronger metals, such as titanium. A significant number of the premium metal woods, especially drivers, are now constructed primarily using titanium. The use of titanium and other lightweight, strong metals has made it possible to create metal woods of ever increasing sizes. The size of metal woods, especially drivers, is often referred to in terms of volume. For instance, current drivers may have a volume of 300 cubic centimeters (cc) or more. Oversized metal woods generally provide a larger sweet spot and a higher inertia, which provides greater forgiveness than a golf club having a conventional head size.

One advantage derived from the use of lighter and stronger metals is the ability to make thinner walls, including the striking face and all other walls of the metal wood club. This allows designers more leeway in the positioning of weights. For instance, to promote forgiveness, designers may move the weight to the periphery of the metal wood head and backwards from the face. As mentioned above, such weighting generally results in a higher inertia, which results in less twisting due to off-center hits.

There are limitations on how large a golf club head can be manufactured, which is a function of several parameters, including the material, the weight of the club head and the strength of the club head and the materials used. Additionally, to avoid increasing weight, as the head becomes larger, the thickness of the walls must be made thinner, including that of the striking face. As a result, as the striking face becomes thinner and thinner, it has a tendency to deflect more and more at impact, and thereby has the potential to impart more energy to the ball. This phenomenon is generally referred to as the "trampoline effect." A properly constructed club with a thin face can therefore impart a higher initial velocity to a golf ball than a club with a rigid face. Because initial velocity is an important component in determining how far a golf ball travels, this is very important to golfers.

It is appreciated by those skilled in the art that the initial velocity imparted to a golf ball by a thin-faced metal wood varies depending on the location of the point of impact of a golf ball on the striking face. Generally, balls struck in the sweet spot will have a higher rebound velocity. Many factors contribute to the location of the sweet spot, including the location of the center of gravity (CG) and the shape and thickness of the striking face.

Prior golf club heads have attempted to increase the initial or launch velocity of a golf ball by forming a lightweight, flexible face. Manufacturers of metal wood golf club heads have more recently attempted to manipulate the performance of their club heads by designing what is generically termed a variable face thickness profile for the striking face, in particular with the use of lightweight materials such as titanium alloys.

Another approach to reduce stress at impact is to use one or more ribs extending substantially from the crown to the sole vertically across the face, and in some instances also extending from the toe to the heel horizontally across the face. Because the largest stresses are located at the impact point, usually at or substantially near the sweet spot, the center of the face is always thickened and is at least as thick as the ribbed portions.

There have been other configurations and ribs formed on the back of a club face, including one or more thin rings, a power bar, and a cone formation. Multiple thin rings have been attached by various means so as to add mass directly behind the sweet spot, and alternatively a spiral formation has been used, wherein the multiple rings or spiral mass extend from the sweet spot substantially toward the periphery of the face plate. A single thin ring at the sweet spot has been used on an iron club head in conjunction with an added toe mass in order to reposition a point of least rigidity to the center of the face. In this configuration the rigidity of the face is always higher radially outward from the centered ring.

Other club heads have attempted to utilize power bars or cones behind the sweet spot in order to increase the force imparted to a golf ball. These power bars and cones involve significant additional mass extending toward a rear of the club head, thus affecting the club head CG. However, such club heads do not provide a coefficient of restitution (COR) that is at least the minimum value of approximately 0.8 that is sought by today's golfers.

The COR for a golf club may be informally defined as a function of the ratio of the relative velocities of a golf ball, just prior to and immediately after impact with the golf club head. The COR baseline value of e=0.822 has been established in the United States, and the formal equation also accounts for the relative masses of a specific club head as well as a golf ball, as follows:

$$V_{out}/V_{in}=(eM-m)/(M+m)$$

(where M is the mass of the club head and m is an average mass of the golf ball population. $V_{out}$ is the ball rebound velocity and $V_{in}$ is the incoming velocity of the ball that is shot at the face of the golf club head using an air cannon, for example.)

In each of the foregoing examples, however, there is ultimately a failure to provide significant forgiveness to off-center hits. Each golf club has attempted to increase COR while addressing to various degrees the difficulties in doing so. For these clubs, the point of impact must still be at the sweet spot in order for these clubs to deliver their highest COR, and even the slightest deviation of the impact from the sweet spot will result in a significant loss in ball velocity.

SUMMARY OF THE INVENTION

The present invention provides a solution to enable club designers to overcome the problems described above, including a golf club head that exhibits greater forgiveness across a substantial portion of the striking face while continuing to impart high initial velocity to a golf ball.

In a preferred embodiment of the invention, a golf club head having a coefficient of restitution measuring at least about 0.8 is provided. The club head has a body having a toe portion, a heel portion, a sole portion and a crown portion together defining a front opening. An insert is disposed in the opening and has a substantially planar striking surface on a first side, a rear surface on a second side and a periphery for attachment at the opening on the body. This periphery has a top edge, a bottom edge, a first side edge and a second side edge. The striking surface has a balance point at a central region of the insert and each point on the striking surface has a thickness, and the striking surface has a total area on the insert.

The face insert has a first thickness profile between the balance point and the top edge, a second thickness profile between the balance point and the bottom edge, a third thickness profile between the balance point and the first side edge and a fourth thickness profile between the balance point and the second side edge. The first, second, third and fourth thickness profiles similarly have thickness values at first locations encompassing the periphery of the striking face and including minimum values adjacent the edges. The thickness profiles similarly have thickness values at least 1.5 times the minimum values at second locations between the first locations and the balance point, and the second locations include points having maximum thickness values. The thickness profiles similarly have thickness values at third locations in the central region that are less than the values at the second locations but greater than the minimum values at the first locations.

The first, second, third and fourth thickness profiles in combination represent a substantially annular region of increased thickness comprising the second locations. The thickness values of the third locations form a reduced thickness region, and an area including the substantially annular region and the reduced thickness region extend about 50% of the distance from the balance point to each of the top and bottom edges and the first and second side edges.

Alternatively, a golf club head of the present invention may comprise a body defining a toe portion, a heel portion, a sole portion, a crown portion, and a face portion. The face portion has a striking surface on an outer side and a periphery substantially adjacent a first junction at the face and crown portions, a second junction at the face and sole portions, a third junction at the face and toe portions, and a fourth junction at the face and heel portions. The striking surface has a total area as measured on its outer side, and it has a balance point at a central region of the face portion.

Each point on the striking surface has a local cross-sectional bending stiffness such that the face portion has a first stiffness profile between the balance point and the first junction and a second stiffness profile between the balance point and the third junction. The first and second stiffness profiles similarly have low first stiffness values at first locations that are farthest from the balance point and that encompass the periphery of the striking face. The first and second stiffness profiles similarly have high second stiffness values at second locations that are between the periphery and the balance point, and the first and second stiffness profiles similarly have third stiffness values at the central region.

The face portion is substantially symmetric about central vertical and horizontal axes such that the first stiffness profile also applies between the balance point and the second junction, and the second stiffness profile applies between the balance point and the fourth junction. The first stiffness values include minimum values adjacent the first, second, third and fourth junctions, with the first stiffness values increasing to less than about 3.4 times the minimum values. The second stiffness values are at least about 3.5 times the minimum values, and the third stiffness values are greater than the minimum values and less than about 3.5 times the minimum values. The second and third stiffness values comprise an area of the striking surface that extends approximately halfway from the balance point to the first, second, third and fourth junctions.

In another embodiment of the present invention, a face insert for a golf club head comprises a substantially planar striking surface on a first side of the insert, a rear surface on a second side and a periphery for attachment to the golf club head. The periphery has a top edge, a bottom edge, a first side edge and a second side edge. The striking surface has a balance point at a central region of the face insert and each point on the striking surface has a local cross-sectional bending stiffness. The striking surface has a total area on the first side of the insert.

The face insert has a first stiffness profile between the balance point and the top edge, a second stiffness profile between the balance point and the bottom edge, a third stiffness profile between the balance point and the first side edge and a fourth stiffness profile between the balance point and the second side edge. The first, second, third and fourth stiffness profiles have stiffness values at first locations that encompass the periphery of the striking face and include minimum values adjacent the edges. The stiffness profiles have stiffness values at second locations between the first locations and the balance point that are at least 3.5 times the minimum values which are generally located at the periphery. The second locations include points having maximum stiffness values, and the stiffness profiles have stiffness values at third locations in the central region that are less than the values at the second locations but greater than the minimum values at the first locations.

The first, second, third and fourth stiffness profiles in combination represent a substantially annular region of high stiffness comprising the second locations. The stiffness values of the third locations form a reduced stiffness region including a point having a local minimum stiffness value. The substantially annular region comprises at least about 12% of the total area of the striking surface.

Generally, the present invention can be practiced using a variety of common club head shapes that are known in the art. According to another preferred embodiment of the invention, a hollow metallic body is disclosed. The body has a plurality of thin walls including a toe portion, a heel portion, a sole portion, and a crown portion, wherein all of such portions cooperate to define an interior cavity and to define an opening with a forward edge. A metallic ball striking face is secured to the front edge of the body, using methods that are generally known in the art. This embodiment has a ball string face with substantially uniform wall thickness, as measured from the striking face to the rear surface of the face, except for a portion of the face near the center. Near the center of the face, there is an oblong, washer-shaped region of increased thickness that extends rearwardly into the cavity. The washer-shaped region is preferably formed as an integral part of the rear surface of the striking plate wall, although the washer-shaped region may be fixedly attached to the rear of the face through means known in the art. The washer-shaped region serves to lessen the relative amount of flex in the face and results in a club head that is more forgiving of off-center hits than that of a similar-sized face having a uniform thickness profile. Generally, the region of increased thickness is located radially outward from the sweet spot.

BRIEF DESCRIPTION OF THE DRAWINGS

FIG. 5A is a cross-sectional view along lines B—B of FIG . 5.

FIG. 11 is a rear elevational view of another embodiment of a face insert of the present invention that has discontinuous thicknesses and that is also asymmetric at least as viewed along a line between the heel and toe ends of the insert.

FIG. 12 is a cross-sectional view taken along lines 12—12 of FIG. 11.

FIG. 13 is a cross-sectional view taken along lines 13—13 of FIG. 11.

FIG. 14A is cross-sectional view along lines A—A of FIG. 14.

FIG. 15A is a cross-sectional view along lines A—A of FIG. 15.

DETAILED DESCRIPTION OF THE PREFERRED EMBODIMENTS

Figure 1:
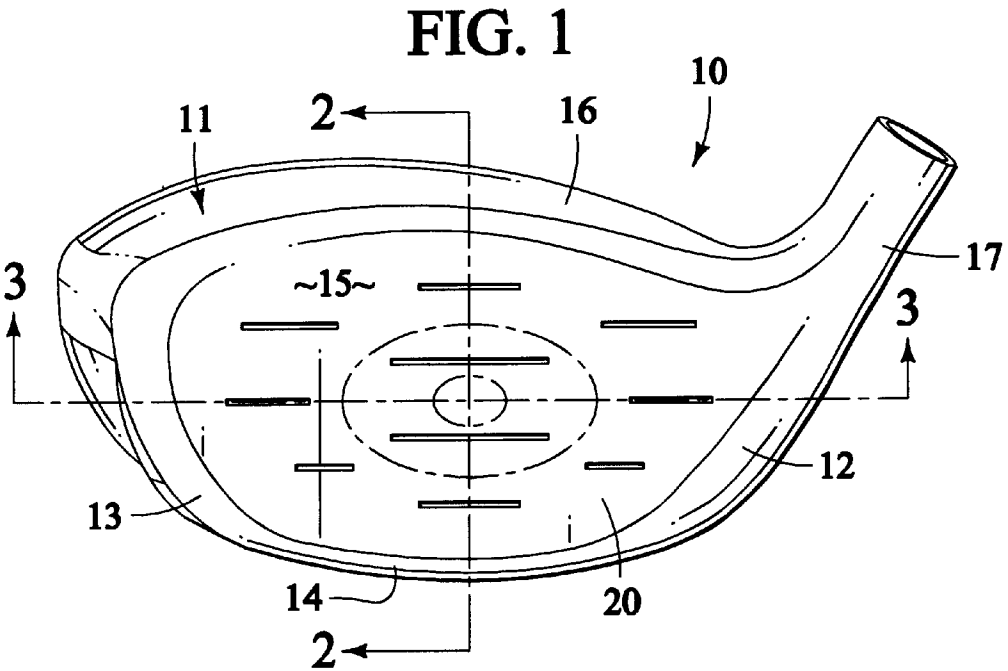
FIG. 1 shows a front view of a first embodiment of a golf club head of the present invention.

The drawings depict several preferred embodiments of a golf club head in accordance with the present invention. With reference to FIG. 1, a club head 10 is shown that is similar to many metal wood club heads that are known in the art. Club heads within the scope of the invention are not necessarily limited to the shape depicted. The club head 10 comprises a hollow metallic body 11 and a striking or face plate 20. The body 11 comprises a heel portion 12, a toe portion 13, a sole portion 14 and a crown portion 16 that cooperate to define an opening (not shown) that receives the striking plate 20. The striking plate 20 is shown in greater detail in FIGS. 2–4. The club head 10 is normally connected to a shaft (not shown) by a hosel 17 that is integrally formed with the body 11. Preferably, the body is constructed of stainless steel or a titanium alloy, but alternatively can be constructed of other materials such as a silicon steel alloy, various composites, and combinations thereof. The club head is preferably manufactured such that the body 11, including the heel portion 12, toe portion 13, sole portion 14, crown portion 16 and hosel 17 are integrally formed, and the striking plate 20 having a striking face 15 is fixedly attached by means known in the art. However, the various portions of the preferred body 11 may be separately molded, cast, forged or otherwise manufactured by means known in the art, and fixedly attached to form the body 11.

Figure 4:
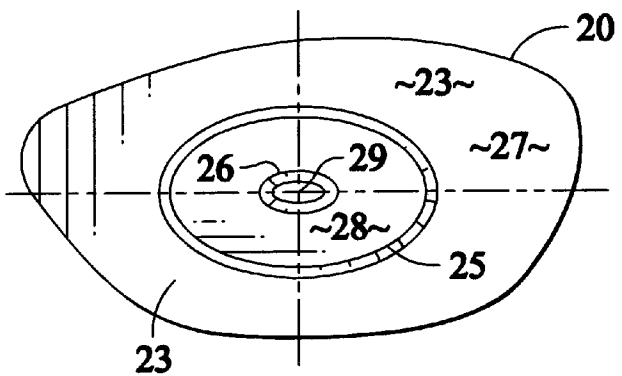
FIG. 4 is a rear elevational view of a face insert corresponding to the golf club head of FIG. 1.

FIG. 4 shows the rear surface 23 of the striking plate formed from stainless steel. The rear surface 23 comprises an outer rear surface 27 and an inner rear surface 29. Between the outer surface 27 and the inner surface 29 is a raised surface 28. The raised surface 28 forms an area that is substantially elliptical. Proximate the raised surface are an outer shoulder 25 and an inner shoulder 26 that form a transition between the raised surface 28 and the outer surface 27 and the inner surface 29. The raised surface 28 and the shoulders 25 & 26 cooperate to form an elliptical, washer-shaped projection that extends rearward toward the inside of the club head cavity.

Figure 5B:
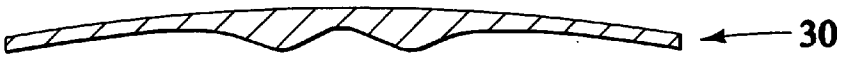
FIG. 5 is a rear elevational view of a forged face insert in a second embodiment of the present invention.
FIG. 5A is a cross-sectional view of along lines A—A of FIG. 5.
Figure 5:
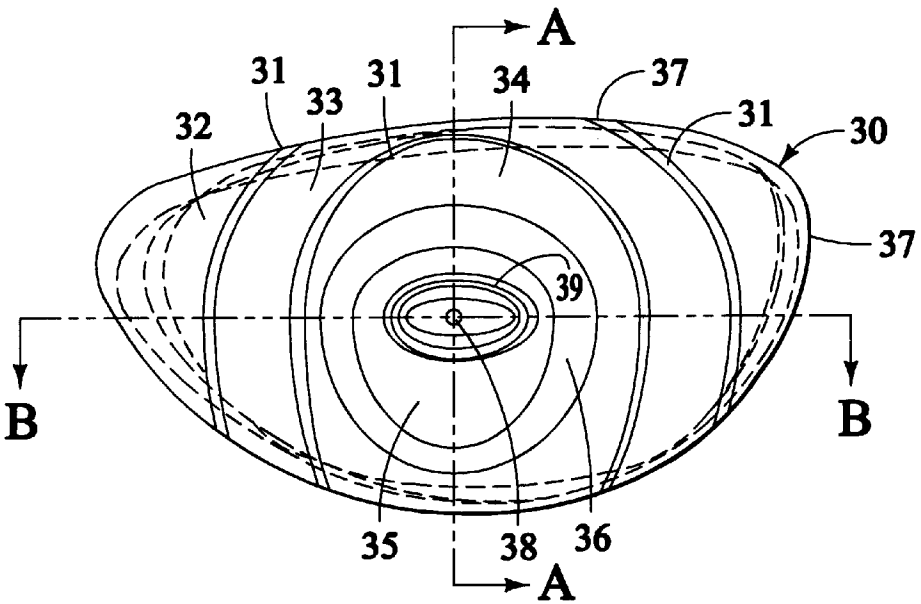
Figure 5A:
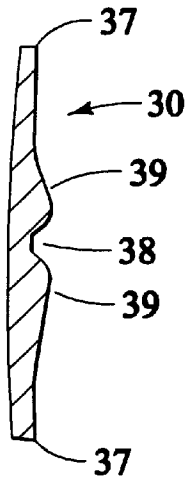

An alternative preferred striking plate 30 may be forged as a unitary structure, as shown in FIG. 5. As indicated by the topographical lines 31 showing the varying thicknesses (32, 33, 34, 35, 36), forging provides the opportunity to form relatively complex surfaces in a fairly simple process. In this example, the thickness ranges from about 1.6 mm near the periphery 37 of the plate, to about 1.9 mm radially inward from the periphery toward a balance point at about the center 38 of the plate 30. The thickness increases to about 2.5 mm further inward, up to a maximum of about 4.8 mm in a generally elliptical portion 39 surrounding a 2.5 mm thickness region at the balance point 38.

Figure 2:
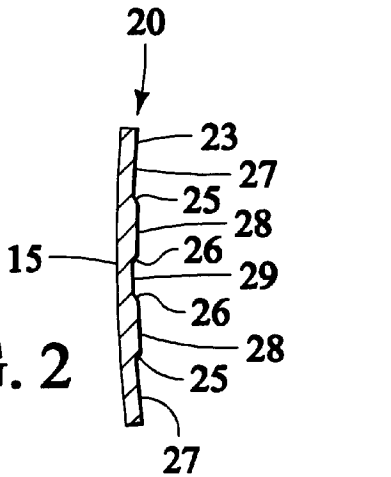
FIG. 2 is a cross-sectional view taken along lines 2—2 of FIG. 1.
Figure 3:
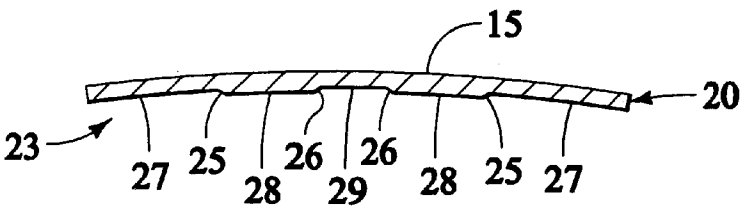
FIG. 3 is a cross-sectional view taken along lines 3—3 of FIG. 1.
Figure 8:
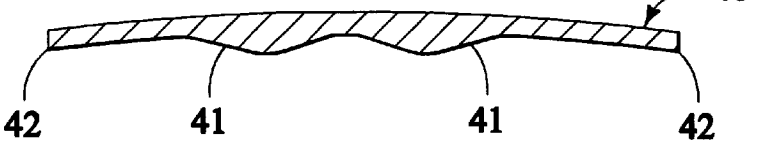
FIG. 8 is a cross-sectional view taken along lines 8—8 of FIG. 6.
Figure 6:
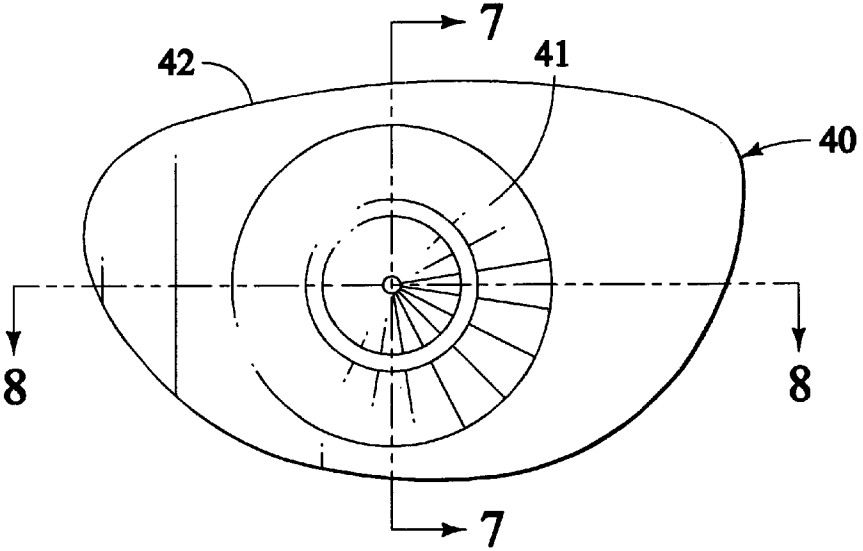
FIG. 6 is a rear elevational view of a machined face insert in another embodiment of the present invention.
Figure 7:
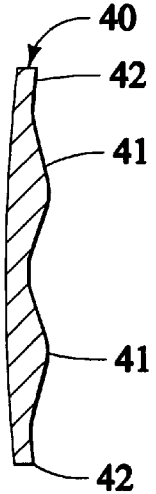
FIG. 7 is a cross-sectional view taken along lines 7—7 of FIG. 6.

FIGS. 6–8 are similar to FIGS. 2–4 in that the thickness variation of the rear of the striking plate 40 of FIGS. 6–8 is more symmetrical than that shown in FIG. 5. The preferred material used in the embodiment of FIGS. 6–8 is a titanium alloy. As shown in FIG. 6 the shape of the generally annular region 41 of increased thickness is round, while in FIG. 2 the annular region of the raised surface 28 was more elliptical. In addition, the annular region shown in FIGS. 7 and 8 is somewhat thicker and more gradual in slope than the region of maximum thickness of the raised surface 28 shown in FIGS. 2 and 3, in which much of the raised surface 28 is substantially flat.

The embodiments of the face portions represented in FIGS. 2–8 share a characteristic that a substantial increase in thickness occurs within about 75% of the distance from the center (e.g. 29, 38) toward the peripheral edges of the plates (e.g. 37). Preferably, the thickness increase occurs within about 50% of the distance from the center to the periphery. Also, the annular regions (e.g. 41) comprise thicknesses that are at least 50% greater than the minimum thickness found at the outermost periphery (42 in FIGS. 6–8) and cover an area at least about 12% of the total area of the striking plate 40. Preferably, the annular region 41 covers an area at least about 15%, and most preferably at least about 20%, of the total area of the striking plate.

Tables I and II summarize areas of inertia welded and forged face embodiments, respectively, according to fraction of total face area for each level of thickness shown.

TABLE I

| Inertia Weld | | |
|---|---|---|
| Thk (mm) | Area (mm^2) | Fraction of face area |
| 2 | 1016 | 0.31 |
| 2.5 | 843 | 0.26 |
| 3 | 666 | 0.20 |
| 3.5 | 485 | 0.15 |
| 4 | 298 | 0.09 |
| 4.5 | 113 | 0.03 |

TABLE II

| Forged Face | | |
|---|---|---|
| Thk (mm) | Area (mm^2) | Fraction of face area |
| 1.6 | 2581 | |
| 2.1 | 1369 | 0.42 |
| 2.6 | 612 | 0.19 |
| 3.1 | 477 | 0.15 |
| 3.6 | 349 | 0.11 |
| 3.1 | 24 | 0.01 |
| 4.6 | 121 | 0.04 |

Figure 9:
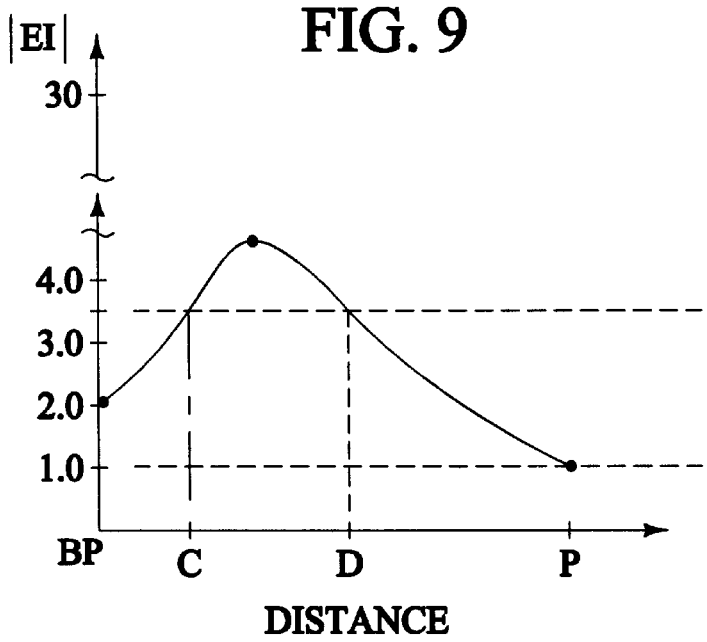
FIG. 9 is a graph showing an embodiment of a stiffness profile from a balance point (BP) of a face to a peripheral point (P).

The present invention as described herein provides a face portion for a golf club head that has specific low, intermediate and high stiffness regions, as represented in FIG. 9. Each point of the face portion (e.g. striking face 15 in FIG. 1) has a local cross-sectional bending stiffness value, EI, associated with it. In particular, the lowest stiffness (EI) is provided at an outermost region from a balance point (BP) of the face, referred to herein generically as the sweet spot. The sweet spot is typically found substantially the geometric center of the striking face (e.g. striking face 15 in FIG. 1).

For a given material, a point on the club face may be considered beam-like in cross-section and its bending stiffness at a given location on the face may be calculated cubed function of its thickness, $h^3$. That is, $EI=f(h^3)$, where E is the Young's Modulus and I is the inertia. Thus, if a first point on the face has a thickness of 2 mm a second point has a thickness of 3 mm, then the second point is 1.5 times thicker has a stiffness that is 3.375 times that of the first point, or:

$$(3mm)^3/(2mm)^3=(1.5)^3=3.375$$

The stiffness values in the central region of the face containing the sweet spot are at least higher than the minimum stiffness found at a peripheral point (P) at the outermost region, however the maximum stiffness of the face is provided a distance radially outward from the sweet spot. The central region does include a locally minimum stiffness value which is still greater than the lowest stiffness found at the outermost region. Referring to FIG. 9, the central region extends from BP to C, while the region including the maximum stiffness extends between C and D. The outer periphery of the face extends from D to P.

Thus, there is a stiffness profile with varying stiffness values corresponding to distances located radially outward from the sweet spot toward the periphery of the face. The striking surface of the face may be represented by quadrants defined by central axes formed from a substantially vertical plane and a substantially horizontal plane that each include the balance point of the face. At least one stiffness profile is included in each quadrant, extending generally radially from the balance point, and may or may not coincide with one of the central axes.

While a particular stiffness profile found along any radial line may or may not be repeated elsewhere on the face, each profile preferably includes at least the minimum value at the greatest radial distance from the sweet spot and the maximum value somewhere between the minimum value and the sweet spot. A generally annular region formed around the central region includes the maximum stiffness values, which generally form an ellipse or circle or the like, as well as stiffness values which are generally higher than those found in either the central region or the outermost region of the face. A preferred boundary stiffness value to differentiate this annular region is at least about 3.5 times the minimum stiffness values.

Figure 10:
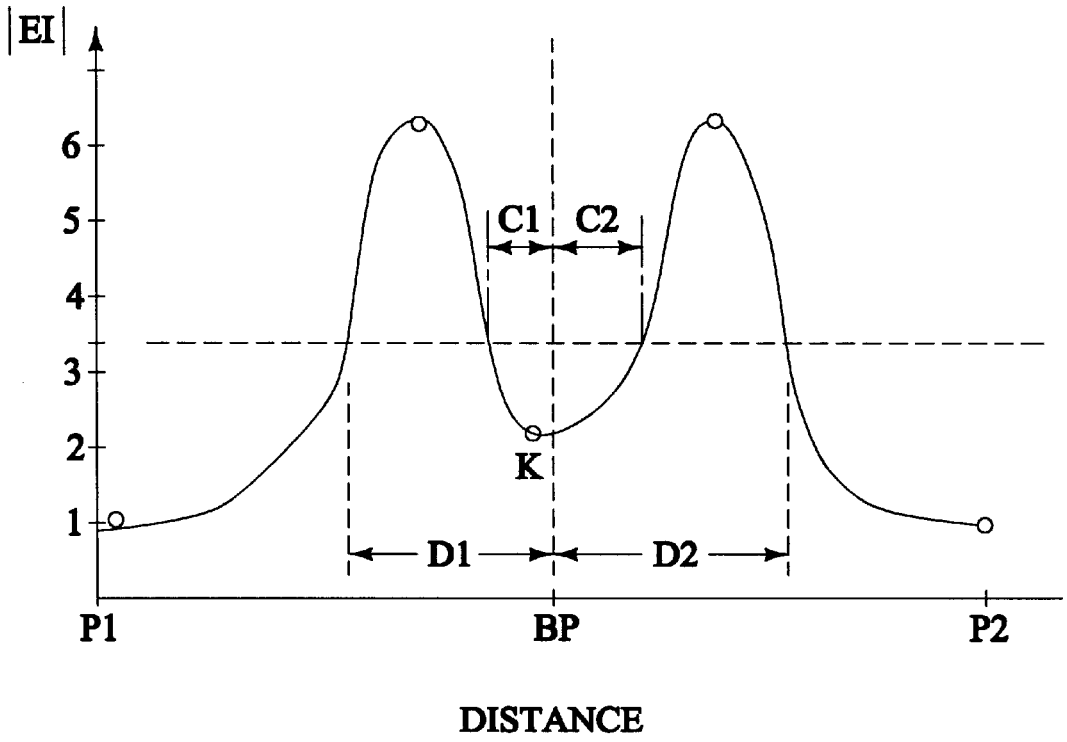
FIG. 10 is a graph showing an embodiment wherein two stiffness profiles of the present invention extend from a balance point and include a local minimum of a central region that is located along the profile extending toward peripheral points $P_1$and $p_2$.

The total central region comprising all of the possible stiffness profiles of the striking plate is in general reduced in stiffness from the surrounding substantially annular region. The local minimum stiffness point K found in the central region may either be at the sweet spot and thus common to any profile taken, or this point may be offset slightly and included only with a specific stiffness profile, as shown in FIG. 10. Here two stiffness profiles are shown and the length from BP to C1 is slightly less than the length from BP to C2; the lengths D1 and D2 from BP may differ, however both extend no more than about halfway to their respective peripheral points P1 and P2.

The specific stiffness profiles, taken along any of the radial lines from the sweet spot, are preferably gradual and continuous, with each region delineated by the boundary values. However, as formed using specific thicknesses, the desired stiffness profiles may be achieved using, for example, constant thickness values having abrupt changes between or within stiffness regions, such as stepped and discontinuous sections. Or, the thicknesses may include smoothly changing and continuous thicknesses, such as chamfered sections. Also, the thicknesses may include extremely variable thicknesses within a region that may be observed as rough or sharp textured surfaces or softer, undulating surfaces. Any combination of these types of thickness profiles may be employed, as long as the resultant stiffness profiles are as prescribed herein.

FIGS. 11–13 show a striking face 50 of the present invention having an alternative thickness pattern. Thickness quadrants have been formed and are divided by an X-shaped section 57 separating individual quadrants (51, 52, 53, 54) that has the same thickness as a periphery 55. This X-shaped section 57 is centered at the balance point 56. The separate regions of increased thickness shown as quadrants (51, 52, 53, 54) are not symmetric about the balance point, as shown in FIG. 12. The quadrant toward the left 52 has a maximum thickness greater than the maximum thickness of the quadrant toward the right 54 of the balance point 56.

The embodiments described in detail herein are merely illustrative and the present invention may be readily embodied using alternative materials, such as composites, in lieu of metals or their alloys, as well as in hybrid constructions utilizing, for example, laminations of metal and composite materials. The club heads may be hollow or filled, have volumes greater than 300 cc or less than about 250 cc, and may comprise unitary or multi-piece bodies. In addition, the face portion may comprise an extension over one or more of the junctions with the top, bottom, toe and heel junctions with or without a hosel formation. Alternatively, it may be desirable to form a substantially unitary head without a separate striking plate, by casting or perhaps by the use of layers of composite plies. In the present invention it is the striking face region at the front of the club head having the specific bending stiffness profiles that is significant.

Advantageously, the present invention is employed to achieve COR values greater than about 0.80 across a greater portion of the striking surface as compared to conventional club heads; e.g., substantially increasing the sweet spot for a so-called "hot" metal wood golf club. However, the advantage of an increased sweet spot of the present invention is also appreciated when applied to other clubs, including utility-type club heads and irons.

Where the present invention is applied to an insert, the separate striking plate may be forged or cast, or various welding techniques may be employed to attach a separate portion behind a constant thickness portion of the striking plate. With a welding attachment of the face insert, a minimum thickness of the striking plate at the periphery should still be present immediately adjacent any weld bead formed. Alternatively, adhesive methods for attachment of the striking plate may be used as known to those skilled in the art. And, while the preferred constructions are described in detail for metal woods, i.e., drivers and fairway woods, it will be appreciated that the present invention may be utilized in irons and other clubs.

In one preferred method of manufacturing the golf club head of the present invention, a separate metallic striking plate is produced using well known forging techniques to form the desired bending stiffness profiles. Laser deposition is also contemplated, wherein a laser device is used to melt a metallic material that is then deposited onto a rear of the striking plate to obtain the desired stiffness profile. Laser devices to perform this process are known to those skilled in the art.

Figure 14A:
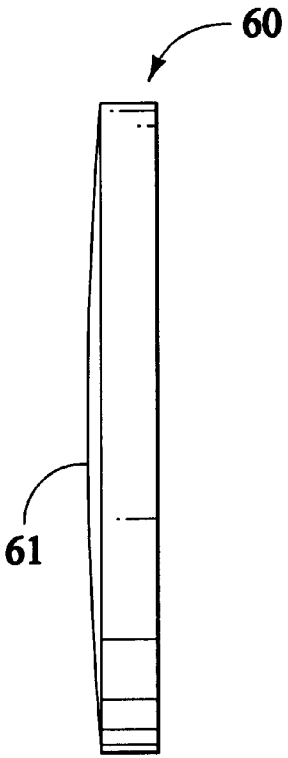
FIGS. 14 and 14A are front and side views, respectively of a rear portion to be inertia welded to face insert of the present invention.
Figure 14:
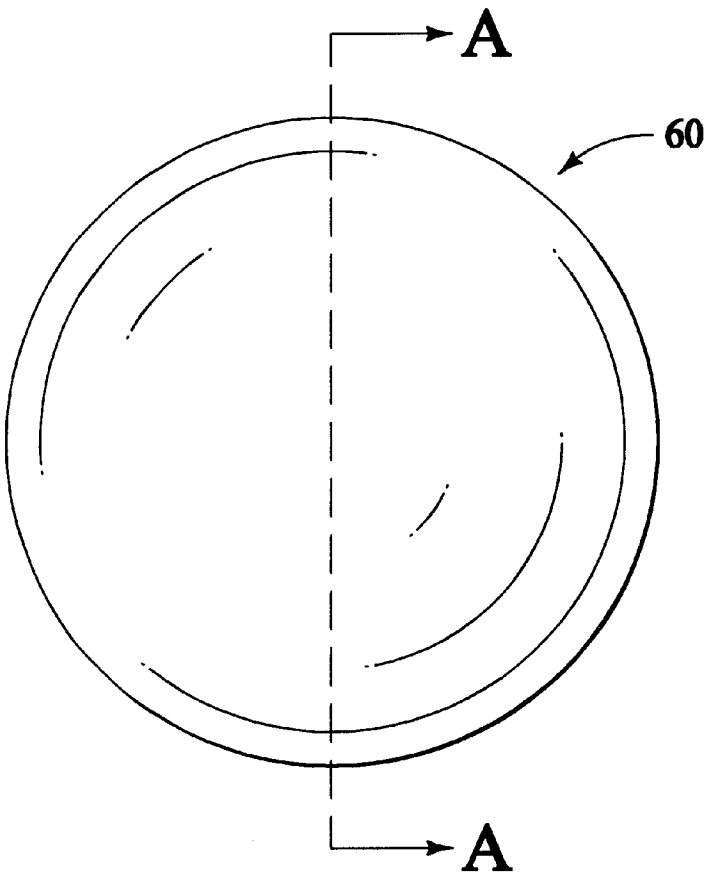
Figure 15A:
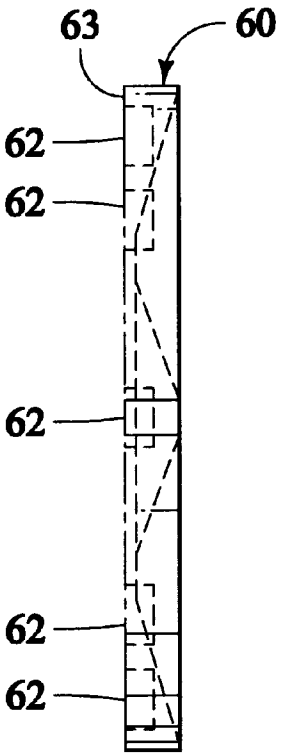
FIGS. 15 and 15A are front and side views of the rear portion of the rear portion shown in FIGS. 14 and 14A after recesses have been formed for attachment of the inertia welding apparatus (not shown).
Figure 15:
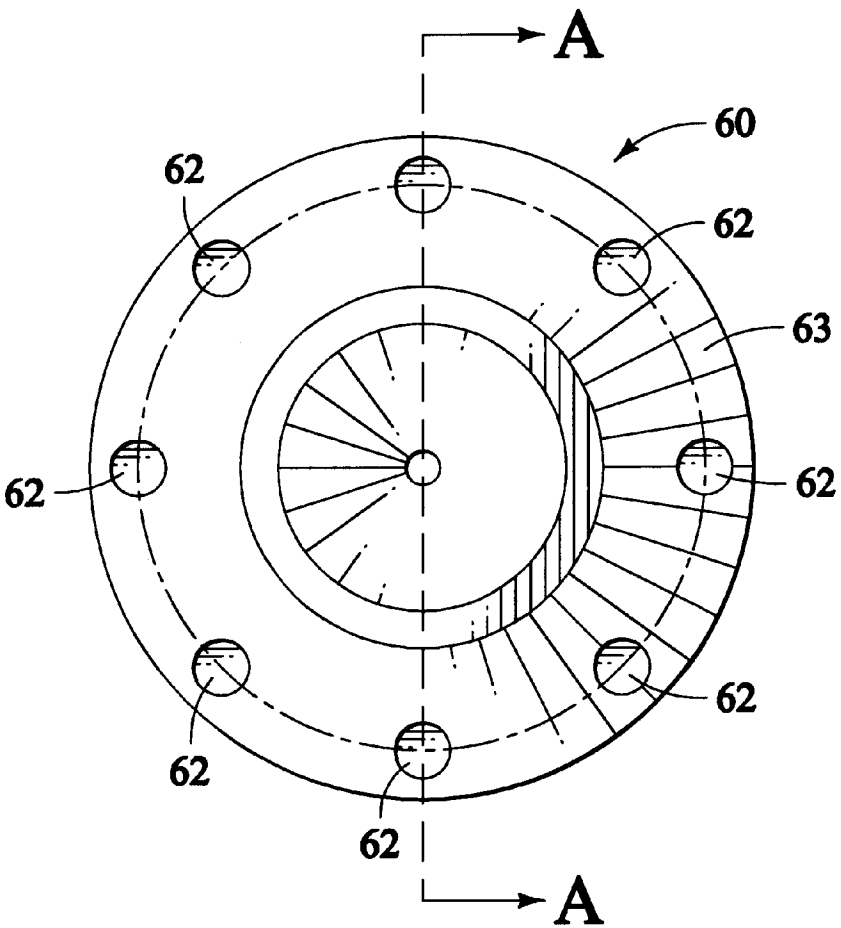
Figure 16A:
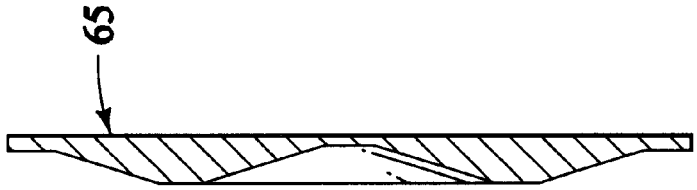
FIGS. 16 and 16A are rear elevational and cross-sectional views with final thicknesses.
Figure 16:
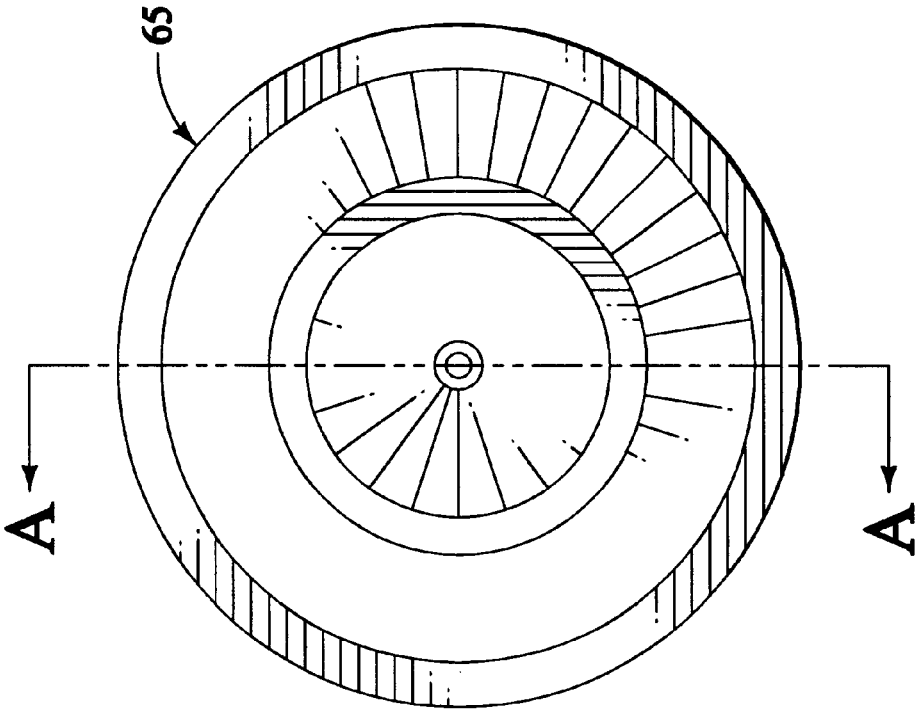

Yet another method provides the desired stiffness profile via a structure formed on the rear of a striking plate by inertia welding a separate piece to a front portion of the insert forming the striking surface. FIGS. 14–16 show the rear portion of a preferred striking plate in a sequence of configurations for attachment. Specifically, FIGS. 14 and 14A show a disk 60 approximately 38 mm in diameter and approximately 3 mm in thickness having a slightly convex surface formed on one side 61. FIGS. 15 and 15A show recesses or drive holes 62 formed around a periphery 63 of the disk, with the depths of the recesses limited by the final thickness of the surface after attachment. A device (not shown) for the inertia welding holds the disk at the recesses until welding is completed. The final shaping of the rear of the striking plate is achieved by machining, with a final preferred shape 65 shown in FIGS. 16 and 16A.

In any of the aforementioned methods, it may be desirable to machine the rear surface of the striking plate as a final step. Alternatively, a substantially constant thickness face may be machined as the process to achieve the desired stiffness profiles, instead of reserving the machining to a final step.

Composite materials may be used to form a face portion and/or to form the remainder of the club head. For the face portion, the desired stiffness profiles may be achieved within a relatively constant thickness by utilizing appropriately positioned materials, such as one or more types of metal fibers of varying Young's Modulus with an epoxy resin. Alternatively, a surface behind the striking surface of the face may be layered with additional plies of composite material to achieve a variable thickness profile. The additional plies may utilize the same or different fibers from those forming the striking surface.

Although the invention has been disclosed in detail with reference only to the preferred embodiments, those skilled in the art will appreciate that additional golf club heads can be made without departing from the scope of the invention. Accordingly, the invention is defined only by the claims set forth below.

We claim:

1. A golf club head, comprising:

a body defining a toe portion, a heel portion, a sole portion, a crown portion, and a face portion;

said face portion comprising a striking surface on an outer side, said face portion having a periphery proximate a first junction of said face and crown portions, proximate a second junction of said face and sole portions, proximate a third junction of said face and toe portions, and proximate a fourth junction of said face and heel portions, said striking surface having a total area measured on said outer side, said striking surface having a balance point at a central region of said face portion; and each point on said striking surface having a local cross-sectional bending stiffness such that said face portion has a first stiffness profile between said balance point and said first junction and a second stiffness profile between said balance point and said third junction, said first and second stiffness profiles similarly having low first stiffness values at first locations farthest from said balance point and encompassing said periphery of said striking face, said first and second stiffness profiles similarly having high second stiffness values at second locations between said periphery and said balance point, and said first and second stiffness profiles similarly having third stiffness values at said central region;

wherein said face portion is substantially symmetric about central vertical and horizontal axes such that said first stiffness profile also applies between said balance point and said second junction and said second stiffness profile applies between said balance point and said fourth junction, said first stiffness values including minimum values adjacent said first, second, third and fourth junctions, said first stiffness values increasing to less than about 3.4 times said minimum values, said second stiffness values being at least about 3.5 times said minimum values, said third stiffness values greater than said minimum values and less than about 3.5 times said minimum values, and said second and third stiffness values comprising an area of said striking surface extending approximately halfway from said balance point to said first, second, third and fourth junctions.

2. The golf club head of claim 1, wherein the coefficient of restitution of the head is greater than 0.80.

3. The golf club head of claim 1, wherein the first and second stiffness values of said first stiffness profile are substantially equal to the first and second stiffness values of said second stiffness profile.

4. The golf club head of claim 1, wherein said third stiffness values comprise a local minimum stiffness value located in said central region.

5. The golf club head of claim 4, wherein said third stiffness values comprise a local minimum stiffness value located at said balance point.

6. The golf club head of claim 1, wherein a combined area of all of said second stiffness values of said stiffness profiles comprises at least about 12% of said total area of said striking surface.

7. The golf club head of claim 1, wherein a combined area of all of said second stiffness values of said stiffness profiles comprises at least about 15% of said total area of said striking surface.

8. The golf club head of claim 1, wherein a combined area of all of said second stiffness values of said stiffness profiles comprises at least about 20% of said total area of said striking surface.

9. The golf club head of claim 1, wherein said body is a hollow cavity closed by said face portion.

10. The golf club head of claim 1, wherein said body at least partially comprises at least one type of metal or alloy material.

11. The golf club head of claim 10, wherein said face portion comprises at least one type of metal or alloy material.

12. The golf club head of claim 10, wherein said face portion at least partially comprises a composite material.

13. The golf club head of claim 1, wherein said body at least partially comprises a composite material.

14. A face insert for a golf club head, comprising:

a substantially planar striking surface on a front side of said insert, a rear surface on a rear side and a periphery for attachment to the golf club head, said periphery having a top edge, a bottom edge, a first side edge and a second side edge, said striking surface having a balance point at a central region of said face insert and each point on said striking surface having a local cross-sectional bending stiffness profile, said striking surface having a total area on said front side of said insert;

said face insert having a first stiffness profile between said balance point and said top edge, a second stiffness profile between said balance point and said bottom edge, a third stiffness profile between said balance point and said first side edge and a fourth stiffness profile between said balance point and said second side edge; and said first, second, third and fourth stiffness profiles having stiffness values at first locations encompassing said periphery of said striking face and including minimum values adjacent said periphery, said stiffness profiles having stiffness values at least 3.5 times said minimum values at second locations between said first locations and said balance point, said second locations including points having maximum stiffness values, said stiffness profiles having stiffness values at third locations in said central region that are less than the values at said second locations but greater than said minimum values at said first locations;

wherein said first, second, third and fourth stiffness profiles in combination represent a substantially annular region of high stiffness comprising said second locations, the stiffness values of said third locations forming a reduced stiffness region including a point having a local minimum stiffness value, said substantially annular region comprising at least about 12% of said total area of said striking surface.

15. The face insert of claim 14, wherein said substantially annular region comprises at least about 15% of said total area of said striking surface.

16. The face insert of claim 14, wherein said substantially annular region comprises at least about 20% of said total area of said striking surface.

17. The face insert of claim 14, wherein each of said first, second, third and fourth stiffness profiles are separately located within one of four quadrants defined by substantially central vertical and horizontal axes extending through said balance point of said striking surface.

18. The face insert of claim 14, wherein each of said first, second, third and fourth stiffness profiles are defined along four separate portions of substantially central vertical and horizontal axes extending through said balance point of said striking surface, said balance point delineating said separate portions.

19. A golf club head, comprising:

a body having a toe portion, a heel portion, a sole portion and a crown portion together defining a front portion;

said front portion having a substantially planar striking surface provided on a front side, a rear surface on a rear side and a periphery, said periphery having a top edge, a bottom edge, a first side edge and a second side edge, said striking surface having a balance point at a central region of said front portion and each point on said striking surface having a local cross-sectional bending stiffness, said striking surface having a total area on said front side of said front portion;

said front portion having a first stiffness profile between said balance point and said top edge, a second stiffness profile between said balance point and said bottom edge, a third stiffness profile between said balance point and said first side edge and a fourth stiffness profile between said balance point and said second side edge; and said first, second, third and fourth stiffness profiles having stiffness values at first locations encompassing said periphery of said striking face and including minimum values adjacent said periphery, said stiffness profiles having stiffness values at least 3.5 times said minimum values at second locations between said first locations and said balance point, said second locations including points having maximum stiffness values, said stiffness profiles having stiffness values at third locations in said central region that are less than the values at said second locations but greater than said minimum values at said first locations;

wherein said first, second, third and fourth stiffness profiles in combination represent a substantially annular region of high stiffness comprising said second locations, the stiffness values of said third locations forming a reduced stiffness region including a point having a local minimum stiffness value, said substantially annular region comprising at least about 12% of said total area of said striking surface.

20. The golf club head of claim 19, wherein the coefficient of restitution of said head is at least 0.80.

21. The golf club head of claim 19, wherein each of said first, second, third and fourth stiffness profiles are separately located within one of four quadrants defined by substantially central vertical and horizontal axes extending through said balance point of said striking surface.

22. The golf club head of claim 19, wherein each of said first, second, third and fourth stiffness profiles are defined along four separate portions of substantially central vertical and horizontal axes extending through said balance point of said striking surface, said balance point delineating said separate portions.

23. A face insert for a golf club head, comprising:

a substantially planar striking surface on a front side of said insert, a rear surface on a rear side and a periphery for attachment to the golf club head, said periphery having a top edge, a bottom edge, a first side edge and a second side edge, said striking surface having a balance point at a central region of said face insert and each point on said striking surface having a local cross-sectional bending stiffness profile, said striking surface having a total area on said front side of said insert;

said face insert having a first stiffness profile between said balance point and said top edge, a second stiffness profile between said balance point and said bottom edge, a third stiffness profile between said balance point and said first side edge and a fourth stiffness profile between said balance point and said second side edge; and said first, second, third and fourth stiffness profiles similarly having stiffness values at first locations encompassing said periphery of said striking face and including minimum values adjacent said periphery, said stiffness profiles similarly having stiffness values at least 3.5 times said minimum values at second locations between said first locations and said balance point, said second locations including points having maximum stiffness values, said stiffness profiles similarly having stiffness values at third locations in said central region that are less than the values at said second locations but greater than said minimum values at said first locations;

wherein said first, second, third and fourth stiffness profiles in combination represent a substantially annular region of high stiffness comprising said second locations, the stiffness values of said third locations forming a reduced stiffness region including a point having a local minimum stiffness value, said substantially annular region and said reduced stiffness region extending about 50% of the distance from said balance point to each of said top and bottom edges and said first and second side edges.

24. The insert of claim 23, comprising a first portion of substantially constant thickness having said striking surface formed thereon and a second portion of varying thickness forming said rear surface of said insert.

25. The insert of claim 24, wherein said first and second portions of said insert are separately formed and fixedly attached together.

26. The insert of claim 24, wherein said first and second portions of said insert are integrally formed.

27. A method of manufacturing a face insert for a golf club head having a coefficient of restitution of at least 0.80, comprising:

forming a first surface on a front side of said insert, said first surface comprising a periphery having a top edge, a bottom edge, a first side edge and a second side edge, said first surface having a total area on said front side of said insert, said first surface having a balance point at a central region, and each point on said first surface having a local cross-sectional bending stiffness value;

forming a second surface on a rear side of said insert;

forming said face insert to result in a first stiffness profile between said balance point and said top edge, a second stiffness profile between said balance point and said bottom edge, a third stiffness profile between said balance point and said first side edge and a fourth stiffness profile between said balance point and said second side edge;

providing said first, second, third and fourth stiffness profiles such that they similarly have stiffness values at first locations encompassing said periphery of said first face and including minimum values adjacent said edges;

providing said stiffness profiles such that they similarly have stiffness values at least 3.5 times said minimum values at second locations between said first locations and said balance point, said second locations including points having maximum stiffness values; and providing said stiffness profiles such that they similarly have stiffness values at third locations in said central region that are less than the values at said second locations but greater than said minimum values at said first locations;

wherein said first, second, third and fourth stiffness profiles in combination forming a substantially annular region of high stiffness comprising said second locations, the stiffness values of said third locations forming a reduced stiffness region including a point having a local minimum stiffness value, said substantially annular region and said reduced stiffness region extending about 50% of the distance from said balance point to each of said top and bottom edges and said first and second side edges.

28. The method of claim 27, wherein said insert is formed by forging.

29. The method of claim 27, further comprising the step of forming a first portion of said insert having a substantially constant thickness and a said second portion having a varying thickness, said second portion forming said second surface of said insert.

30. The method of claim 29, wherein said second portion is formed by laser deposition.

31. The method of claim 29, comprising separately forming said first and second portions of said insert and fixedly attaching them together.

32. The method of claim 31, wherein fixed attachment is by inertia welding.

33. The method of claim 31, wherein fixed attachment is by laser welding.

34. The method of claim 29, wherein said first and second portions of said insert are integrally formed.

35. The method of claim 34, wherein said second portion is machined to obtain said stiffness profiles of said insert.

36. The method of claim 29, wherein said first portion comprises a first material and said second portion comprises a second material.

37. The method of claim 36, wherein at least a portion of said first material is different from said second material.

38. The method of claim 29, wherein said first portion comprises a substantially even layering of composite material.

39. The method of claim 38, wherein said second portion comprises selectively placing one or more plies of composite material onto said first portion to achieve said stiffness profiles.

40. A golf club head, comprising:

a body having a toe portion, a heel portion, a sole portion and a crown portion together defining a front opening;

a face insert having a periphery for attachment at said front opening of said body, a substantially planar striking surface on a front side of said insert and a rear surface on a rear side, said periphery having a top edge, a bottom edge, a first side edge and a second side edge, said striking surface having a balance point at a central region of said face insert and each point on said striking surface having a local cross-sectional bending stiffness, said striking surface having a total area on said first side of said insert;

said face insert having a first stiffness profile between said balance point and said top edge, a second stiffness profile between said balance point and said bottom edge, a third stiffness profile between said balance point and said first side edge and a fourth stiffness profile between said balance point and said second side edge; and said first, second, third and fourth stiffness profiles similarly having stiffness values at first locations encompassing said periphery of said striking face and including minimum values adjacent said edges, said stiffness profiles similarly having stiffness values at least 3.5 times said minimum values at second locations between said first locations and said balance point, said second locations including points having maximum stiffness values, said stiffness profiles similarly having stiffness values at third locations in said central region that are less than the values at said second locations but greater than said minimum values at said first locations;

wherein said first, second, third and fourth stiffness profiles in combination represent a substantially annular region of high stiffness comprising said second locations, the stiffness values of said third locations forming a reduced stiffness region including a point having a local minimum stiffness value, said substantially annular region and said reduced stiffness region extending about 50% of the distance from said balance point to each of said top and bottom edges and said first and second side edges.

41. The golf club head of claim 40, wherein said insert is forged.

42. The golf club head of claim 40, wherein said head has a coefficient of restitution of at least 0.80.

43. The golf club head of claim 40, wherein said face insert comprises a material different than a material of said body of the club head.

44. The golf club head of claim 40, further comprising a first portion of said insert having a substantially constant thickness and a second portion having varying thickness, said second portion forming said rear surface of said insert.

45. The golf club head of claim 44, wherein said first and second portions of said insert are integrally formed.

46. The golf club head of claim 44, wherein said first portion comprises a first material and said second portion comprises a second material.

47. The golf club head of claim 44, wherein said first portion comprises a substantially even layering of composite material.

48. The golf club head of claim 47, wherein said second portion comprises one or more selectively placed plies of composite material placed onto said first portion to achieve the stiffness profiles.

49. The golf club head of claim 44, wherein said first and second portions are separately formed and rigidly attached.

50. The golf club head of claim 49, wherein said second portion is welded to said first portion.

51. A face insert for a golf club head, comprising:

a substantially planar striking surface on a front side of said insert, a rear surface on a rear side and a periphery for attachment to the golf club head, said periphery having a top edge, a bottom edge, a first side edge and a second side edge, said striking surface having a balance point at a central region of said face insert and each point on said striking surface having a thickness, said striking surface having a total area on said first side of said insert;

said face insert having a first thickness profile between said balance point and said top edge, a second thickness profile between said balance point and said bottom edge, a third thickness profile between said balance point and said first side edge and a fourth thickness profile between said balance point and said second side edge; and said first, second, third and fourth thickness profiles similarly having thickness values at first locations encompassing said periphery of said striking face and including minimum values adjacent said edges, said thickness profiles similarly having thickness values at least 1.5 times said minimum values at second locations between said first locations and said balance point, said second locations including points having maximum thickness values, said thickness profiles similarly having thickness values at third locations in said central region that are less than the values at said second locations but greater than said minimum values at said first locations;

wherein said first, second, third and fourth thickness profiles in combination represent a substantially annular region of increased thickness comprising said second locations, the thickness values of said third locations forming a reduced thickness region, and said substantially annular region comprises at least about 12% of said total area of said striking surface.

52. The insert of claim 51, wherein said substantially annular region is substantially continuous.

53. The insert of claim 51, wherein said substantially annular region is not continuous.

54. The insert of claim 51, wherein said substantially annular region is substantially elliptical.

55. The insert of claim 51, wherein said substantially annular region has an undulating outer surface.

56. The insert of claim 51, wherein said substantially annular region is comprised of substantially planar surfaces that are smoothly contiguous.

57. A face insert for a golf club head, comprising:

a substantially planar striking surface on a front side of said insert, a rear surface on a rear side and a periphery for attachment to the golf club head, said periphery having a top edge, a bottom edge, a first side edge and a second side edge, said striking surface having a balance point at a central region of said face insert and each point on said striking surface having a thickness, said striking surface having a total area on said first side of said insert;

said face insert having a first thickness profile between said balance point and said top edge, a second thickness profile between said balance point and said bottom edge, a third thickness profile between said balance point and said first side edge and a fourth thickness profile between said balance point and said second side edge; and said first, second, third and fourth thickness profiles similarly having thickness values at first locations encompassing said periphery of said striking face and including minimum values adjacent said edges, said thickness profiles similarly having thickness values at least 1.5 times said minimum values at second locations between said first locations and said balance point, said second locations including points having maximum thickness values, said thickness profiles similarly having thickness values at third locations in said central region that are less than the values at said second locations but greater than said minimum values at said first locations;

wherein said first, second, third and fourth thickness profiles in combination represent a substantially annular region of increased thickness comprising said second locations, the thickness values of said third locations forming a reduced thickness region, and an area including said substantially annular region and said reduced thickness region extending about 50% of the distance from said balance point to each of said top and bottom edges and said first and second side edges.

58. The insert of claim 57, wherein said substantially annular region is substantially continuous.

59. The insert of claim 57, wherein said substantially annular region is not continuous.

60. The insert of claim 57, wherein said substantially annular region has an undulating outer surface.

61. The insert of claim 57, wherein said substantially annular region is comprised of substantially planar surfaces that are smoothly contiguous.

62. A golf club head having a coefficient of restitution measuring at least about 0.80, comprising:

a body having a toe portion, a heel portion, a sole portion and a crown portion together defining a front opening;

an insert disposed in said opening, said insert having a substantially planar striking surface on a front side, a rear surface on a rear side and a periphery for attachment at said opening, said periphery having a top edge, a bottom edge, a first side edge and a second side edge, said striking surface having a balance point at a central region of said face insert and each point on said striking surface having a thickness, said striking surface having a total area on said first side of said insert;

said face insert having a first thickness profile between said balance point and said top edge, a second thickness profile between said balance point and said bottom edge, a third thickness profile between said balance point and said first side edge and a fourth thickness profile between said balance point and said second side edge; and said first, second, third and fourth thickness profiles similarly having thickness values at first locations encompassing said periphery of said striking face and including minimum values adjacent said edges, said thickness profiles similarly having thickness values at least 1.5 times said minimum values at second locations between said first locations and said balance point, said second locations including points having maximum thickness values, said thickness profiles similarly having thickness values at third locations in said central region that are less than the values at said second locations but greater than said minimum values at said first locations;

wherein said first, second, third and fourth thickness profiles in combination represent a substantially annular region of increased thickness comprising said second locations, the thickness values of said third locations forming a reduced thickness region, and an area including said substantially annular region and said reduced thickness region extending about 50% of the distance from said balance point to each of said top and bottom edges and said first and second side edges.

63. A golf club head having a coefficient of restitution measuring at least about 0.80, comprising:

a body having a crown and a sole that cooperate to define an opening, a face plate fixedly secured proximate the opening, wherein the face plate is oriented generally vertically, having a sweet spot that defines the preferred location at which a golf ball is to be struck;

wherein the face plate defines a thickened, generally ring-shaped region surrounding the face plate's geometric center, a reduced thickness inner region radially inward of the ring-shaped region and including the face plate's geometric center, and a thin outer region radially outward of the geometric center and the ring-shaped region, wherein at least one boundary line separates the ring-shaped region from the outer region, said boundary line being located where the face plate has a thickness that is about 50% more than the minimum thickness of the outer region, and wherein the combined area of the ring-shaped and inner regions is between about 25% and about 75% of the total area of the ring-shaped, inner and outer regions.

64. The golf club head of claim 63, wherein the ring-shaped region is circumferentially continuous.

65. The golf club head of claim 63, wherein the ring-shaped region is substantially circular.

66. The golf club head of claim 63, wherein the ring-shaped region is substantially elliptical.

67. The golf club head of claim 63, wherein the ring-shaped region is substantially oblong.

68. The golf club head of claim 63, wherein the inner region has a substantially constant thickness, which is free of any portions having a thickness as thick as the ring-shaped region.

69. A golf club head having a coefficient of restitution measuring at least about 0.80, comprising:

a body having a toe portion, a heel portion, a sole portion, and a crown portion, together defining a front opening;

a striking portion disposed at said opening, said striking portion having a substantially planar striking surface on a front side, a rear surface on a rear side and a periphery for attachment at said opening, said periphery having a top edge, a bottom edge, a first side edge, and a second side edge, said striking surface having a balance point in a central region of said striking portion and each point on said striking surface having a thickness, said striking surface having at striking portion;

said striking portion hang a first thickness profile between said balance point and said top edge, a second thickness profile between said balance point and said bottom edge, a third thickness profile between said balance point and said first side edge, and a fourth thickness profile between said balance point and said second side edge; and said first second, third and fourth thickness profiles having thickness values at first locations encompassing said periphery of said striking face and including minimum values adjacent said edges, second locations positioned between said first locations and said balance point, at least said third and fourth thickness profiles having thickness values at least 1.5 times said minimum values at said second locations, said second locations including points having maximum values, said first, second, third, and fourth thickness profiles having thickness values at third locations in said central region that are less than said maximum values but greater than said minimum values at said first locations;

wherein said first, second, third, and fourth thickness profiles, in combination, represent a substantially annular region of increased thickness comprising said second locations, the thickness values of said third locations forming a reduced thickness region, and an area including said substantially annular region and said reduced thickness region extending at least 50% of the distance from said balance point to each of said top and bottom edges and about 50% of the distance to said first and second side edges.

* * * * *